United States Patent [19]

Jones

[11] 4,245,539

[45] Jan. 20, 1981

[54] MUSICAL PLATFORM

[75] Inventor: Alan P. Jones, Levittown, Pa.

[73] Assignee: Parmac Technology, Inc., Hammonton, N.J.

[21] Appl. No.: 884,335

[22] Filed: Mar. 7, 1978

[51] Int. Cl.[3] ..... G10H 1/32; G10H 1/46

[52] U.S. Cl. ..... 84/1.01; 84/1.27; 84/DIG. 8

[58] Field of Search ..... 84/1.01, 1.09, 1.1, 84/1.24, 1.27, DIG. 7, DIG. 8, DIG. 20; 177/3, 25, 184, 210 R, 210 FP, DIG. 1, DIG. 3

[56] References Cited

U.S. PATENT DOCUMENTS

| | | | |
|---|---|---|---|
| 3,674,097 | 7/1972 | Gile | 177/3 |
| 3,749,810 | 7/1973 | Dow | 84/1.24 |
| 3,922,944 | 12/1975 | Kurosaki et al. | 84/1.01 |
| 3,956,958 | 5/1976 | Nash et al. | 84/1.01 |
| 4,044,642 | 8/1977 | Pearlman et al. | 84/1.1 |
| 4,121,488 | 10/1978 | Akiyama | 84/1.01 |
| 4,153,122 | 5/1979 | Engels et al. | 177/25 |

*Primary Examiner*—Stanley J. Witkowski
*Attorney, Agent, or Firm*—Weinstein & Sutton

[57] ABSTRACT

Apparatus for producing signals of varying volume and pitch which are functions of the magnitude and distribution respectively, of weight (or weights) placed upon a platform hinged at one corner and swingable in mutually orthogonal directions. Sensors convert the physical displacements occurring at first and second corners opposite of the platform adjacent to the hinged corner into signals for controlling the volume and pitch of an output signal. Alternatively, displacement of the platform may be controlled by the application of varying pressure by means other than full body weight, such as the operator's finger(s).

The apparatus may be utilized as a unique means for producing music or musical sounds responsive to a person dancing or otherwise moving upon the platform to provide an entertainment form which is both unusual and enjoyable. The varying degree of sophistication of equipment design enables its use to encompass as diverse a range of devices as that of a rugged toy having a simplicity of design and a sensitive musical instrument capable of producing precise quality tones providing a broad range of applications within the field of entertainment.

11 Claims, 14 Drawing Figures

MUSICAL PLATFORM

BACKGROUND OF THE INVENTION

The present invention relates to a means for producing music or music-like sounds and more particularly to a novel platform means which in combination with sensor means and electronic circuit means produces varying pitch and varying volume in response to varying distribution of weight thereupon.

Musical instruments exist in many types and forms, ranging from the simple wind instruments such as the whistle or flute to instruments which mechanically create air pressure such as the gigantic pipe organs. Most musical instruments require the user to possess a music reading ability in combination with a certain degree of skill with the particular instrument, in order that the instrument produce musical tones (i.e. trumpets), saxaphones and other like wind instruments). Other musical instruments require the user to have an "ear" for music, along with a considerable degree of skill with the particular instrument, in order to produce desireable tones. Also, it is observed that many musicians tend to move with the music they are playing, but are limited in this expression by the confining characteristics of the instruments, except in the case of some of the light hand-held wind instruments and the like. Thus few, if any, instruments provide a means for creating music responsive to body movements.

BRIEF DESCRIPTION OF THE INVENTION AND OBJECTS

The present invention is characterized by means for producing music or music-like sounds while providing a form of entertainment for the user who may not as yet have acquired a music-playing skill, while allowing the more skilled performer a unique freedom of movement, or body expression, in the course of producing music or music-like sounds.

Furthermore, the present invention can be implemented using, in combination with a simple mechanical platform, common electromechanical and/or electronic components in proper circuit configuration to achieve simultaneously variable pitch and the variable volume responses through simple physical movements.

The platform, in one preferred embodiment is rectangular and is swingably mounted to a support surface at a first corner to permit the platform to swing in mutually orthogonal directions. Bias means at second and third corners adjacent to said first corner normally support the second and third corners of the platform a spaced distance above the support surface. The application of weight upon the platform alters the displacement of one or both of said second and third corners depending upon the location of the weight applied to the platform.

Sensors convert the degree of displacement into control signals for controlling the frequency (pitch) and magnitude (volume) of an output signal. The frequencies capable of being developed may cover or lie within the audio range, typically from 20 to 20,000 KHZ, however other applications permit other frequency ranges to be selected. Also the output may be in visually observable form such as a digital readout or in the form of a color range which colors also vary in intensity.

It is therefore one object of the present invention to provide novel means for producing music or music-like sounds in a way that is self-entertaining in the absence of skill or music-reading ability on the part of the performer.

Another object of the present invention is to provide novel means for producing music or music-like sounds by involving the performer in a unique, complete way.

Still another object of the present invention is to provide novel means for producing music or music-like sounds by utilizing simple and inexpensive mechanical and electronic components arranged in such a way as to be easily and inexpensively manufactured, reliable, and capable of being responsive to the full weight of a person at various positions over the full area of the mechanical means.

Another object of the invention is to provide a swingably mounted platform including sensor means for generating signals representative of the magnitude and location of a force applied to the platform which signals may manifest themselves in the form of tones lying within a predetermined audio frequency; or colors lying within a predetermined range of a visually observable color spectrum; or a visually observable readout; or any combination thereof;

Still another object of the invention is to provide simplified means for simultaneously developing a pair of output signals through a single simple physical act.

Still another object of the present invention is to provide simplified means for generating a pair of interrelated signals which may be altered independently of one another through the simple operation of input control means.

BRIEF DESCRIPTION OF THE FIGURES

The above, as well as other objects of the present invention will become apparent when reading the accompanying description and drawing in which.

DETAILED DESCRIPTION OF THE INVENTION AS MANIFESTED IN THE FIGURES

Figure 1:
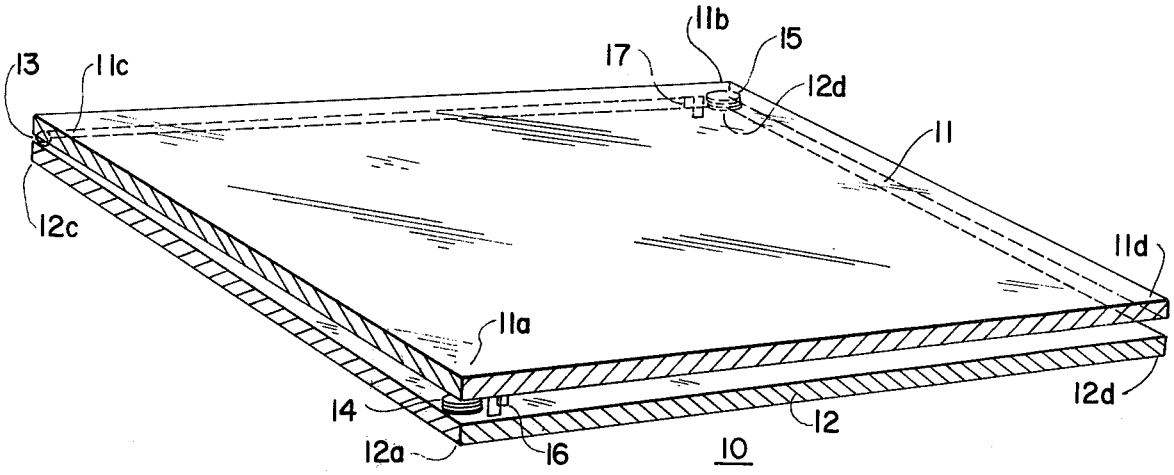
FIG. 1 is a perspective view of a preferred form of a musical platform embodying the principles of the present invention.

FIG. 1 shows a simplified perspective view of a preferred embodiment 10 of the present invention which is comprised of a swingably mounted platform 11 pivotally mounted at its corner 11*c* to one corner 12*c* of a base plate 12 which, although shown as a solid plate of finite thickness for the sake of simplicity, is preferably a hollow rectangular base housing the sensor and signal generating components to be more fully described.

Figure 1A:
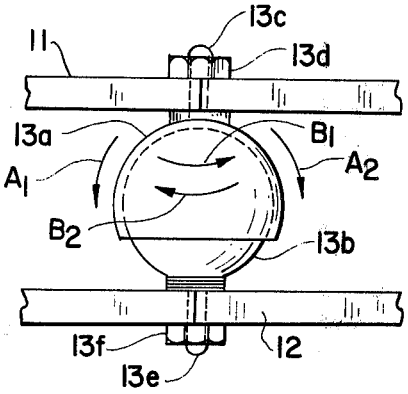
FIG. 1*a* is a detailed view of the pivotal assembly employed at the corner 11*c* of FIG. 1.

Platform 11 is preferably swingably mounted upon base 12 by means of a ball and socket assembly 13 shown in detail in FIG. 1*a*. Hollow truncated spherical member (socket) 13*a* receives the spherical member (ball 13*b*). The upper end of socket 13*a* is integrally joined to a threaded rod 13*c* which extends through an opening (not shown) in platform 11 and is threadedly engaged by a fastening nut 13*d*. Similarly a threaded rod 13*e* integrally joined to ball 13*b*, extends through an opening (not shown) in base 12 and is threadedly engaged by fastening nut 13*f*. The ball and socket joint 13 enables swingable movement of the platform in the mutually orthogonal directions A1–A2 and B1–B2.

Corners 11*a* and 11*b* of platform 11 are biased away from the associated corners 12*a* and 12*b* of base 12 by resilient elements 14 and 15 which may be helical springs, rubber or rubber-like blocks, or any other suitable resilient element capable of undergoing contraction upon the application of a force. Corners 11*d* and 12*d* are free of any connecting or biasing element and have the greatest separation distance in the rest condition. Preferably the separation distance between corners 11*d* and 12*d* may be kept as small as is practical, dependent primarily upon the characteristics of the sensing means to be more fully described hereinbelow.

It can clearly be seen that weight applied upon corner 11*c* would produce no appreciable deflection of plate 11, as it would be supported almost entirely by pivotal means 13. Weight applied in a generally downward direction upon corner 11*a* opposes resilient means 14, causing corner 11*a* to deflect downward toward corner 12*a*, while causing no appreciable motion at corner 11*b*. Conversely, the same weight applied upon corner 11*b* opposes the biasing force of resilient means 15, causing corner 11*b* to deflect downward toward corner 12*b*, while causing no appreciable motion at corner 11*a*. Weight applied upon corner 11*d* will, in accordance with the classical laws of physics governing mechanical lever action, cause a force to act in opposition to both resilient means 14 and 15, causing corners 11*a* and 11*b* to both deflect downward by equal amounts.

It becomes obvious now, that a weight placed upon plate 11 at any point other than directly upon corner 11*c* can cause deflection of corners 11*a* and 11*b* in some combination, and in a controllable, predictable, and repeatable manner.

The platform described hereinabove is a novel and suitable means for controlling an appropriate electronic circuit means for the purpose of producing tones which are musical or music-like in quality.

Figure 2:
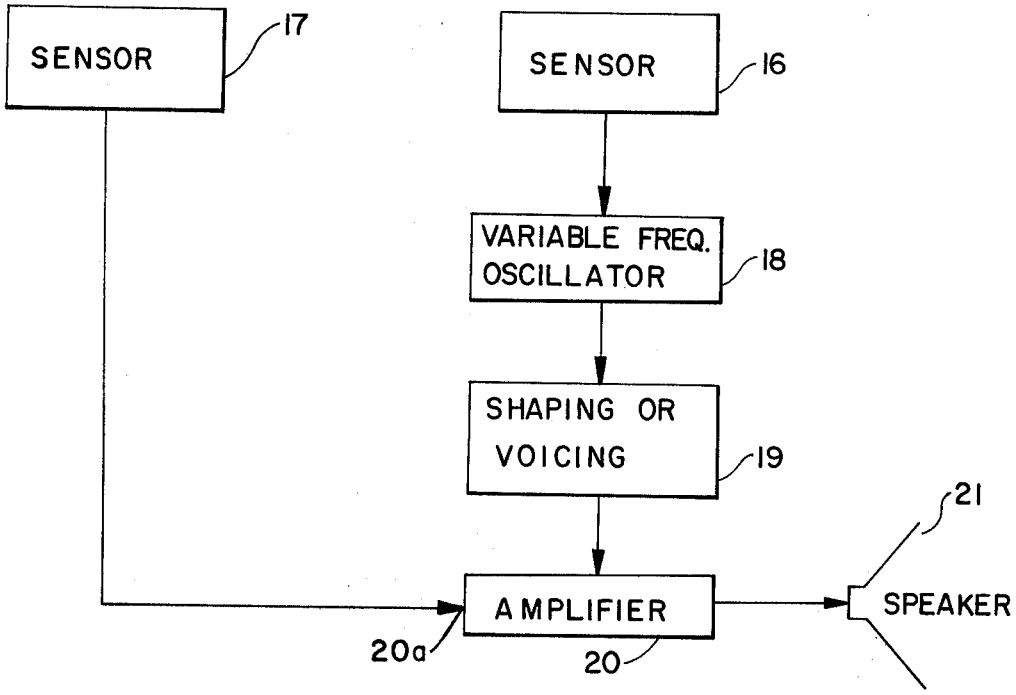
FIG. 2 is a block diagram of the electronic circuit means which produces tones which can be caused to vary in pitch and volume in response to the action of the platform means of FIG. 1.

FIG. 2 illustrates in block diagram form an electronic circuit means which will accomplish the desired objective, making use of the unique action of platform corners 11*a* and 11*b* relative to corners 12*a* and 12*b*, respectively, in response to the application of a force at various points over the area of plate 11.

Sensor means 16 is attached to the platform in such a manner as to sense the deflection of corner 11*a* with respect to corner 12*a*. Oscillator circuit means 18 is frequency responsive to sensor means 16, and the combination is sufficiently sensitive that a range of several octaves is obtained between rest position (no deflection) and full deflection at corner 11*a*.

Oscillator means 18 has its output applied to wave-shaping circuit means 19, which serves to modify the sound to suit the class of instrument. For example, minor overtones are developed and mixed with the fundamental frequency, along with the introduction of a desireable amount of tremolo.

Shaping circuit means 19 output is applied to amplifier 20 which amplifies the variable-pitch tones to a power level suitable for driving speaker 21. The gain of amplifier 20 is responsive to sensor means 17, which is attached to the platform in such a manner as to sense the deflection of corner 11*b* with respect to corner 12*b*. The combination of sensor means 17 and amplifier 20 is sufficiently sensitive that a range of several decibels is obtained between rest position (no deflection) and full deflection of corner 11*b*.

The arrangement described hereinabove will produce the following result, for example:

With the system energized and no weight applied, a very low-pitch sound will be barely audible. Weight applied downward upon the edge of plate 11 between corners 11*b* and 11*c* will cause some deflection of corner 11*b*, moving sensor means 17, increasing the gain of amplifier 20, thus causing the same low-pitch sound to become louder. Moving the weight across the surface of and toward the center of plate 11 will cause some deflection of corner 11*a*, moving sensor 16, thereby increasing the frequency developed by oscillator means 18, thus producing a higher-pitch tone at approximately the same volume. Moving the weight straight toward corner 11*d* increases deflection of both corners 11*a* and 11*b*, and their respective sensor means cause the sound to simultaneously increase in pitch and volume; thus is provided the essential elements of a music-like sound (controlled variations in pitch and volume).

An alternative embodiment of the present invention may be designed to make the volume sensor means 17 output and the oscillator means 18 output directly available to the user, thus facilitating their use and interconnection with external high-powered sound systems of a variety of sophisticated designs. Thus, the present invention includes but is not limited to a self-contained ready-to-play instrument, and further discloses a new and novel means for producing music or music-like electronic or electrical signals in response to a person's weight as it is shifted in position or center of gravity upon its area.

It is obvious to those skilled in the art that the weight-responsive means can be reduced in size to include a simple hand pressure-responsive means in which the base may be hand-held and the platform 11 may be pressed with the other hand (or with the finger or fingers or the other hand), alternatively, the unit may be split into two separate hand-held "squeeze" units 11'-12' and 11''-12'', each containing a resilient member 31 and a sensor 16, 17 for sensing the amount of deflection of the resilient means. Pitch control is accomplished by a squeeze device 11'-12' in one hand, and volume control is similarly accomplished by a squeeze device 11''-12'' in the other hand. Such squeeze devices may each include a resilient means 14 and 15, respectively, and sensor means 16 and 17, respectively, of the present invention.

Figure 1B:
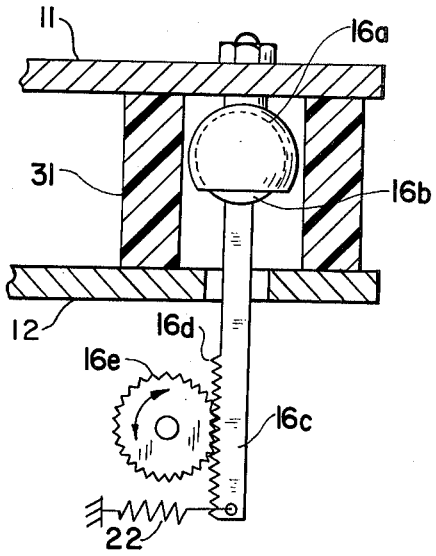
FIGS. 1*b* and 1*c* show detailed views of alternative embodiments which may be employed as one of the sensors of FIG. 1.
Figure 1C:
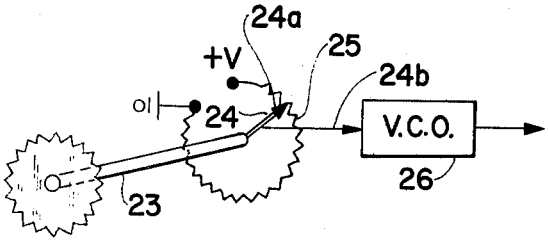

A sensor means for the embodiment of FIG. 1 may be of the type shown in FIGS. 1*b* and 1*c*. As shown, the sensor 16 comprises a socket 16*a* slidably embracing ball 16*b*, forming a ball and socket joint. Rod 16*c* is integrally joined to ball 16*b* and has a rack comprising a linear array of gear teeth 16*d* near its lower end which gear teeth mesh with the gear teeth on the periphery of pinion gear 16*e* forming a rack and pinion gearing. Biasing spring 22 urges the gear teeth 16*d* of the rack against the pinion gear 16*e*.

Pinion gear 16*e* rotates about shaft 23. A potentiometer wiper arm 24 (FIG. 1*c*) is secured to the opposite end of shaft 23 and wipingly engages a resistance element 25 arranged along an arcuate path. The end 24*a* of wiper arm 24 electrically engages the resistance element 25 and couples the contact 24*a* to the input of voltage controlled oscillator (VCO) 26 by lead 24*b*. The output frequency of VCO 26 is a function of the voltage level applied to the control input by lead 24*b*. A toroidal shaped rubber (or rubber-like) resilient element 31 is positioned between platform 11 and base 12 and encircles the socket 16*a* and ball 16*b*. A helical spring can be employed if desired. As another alternative a spongy or rubbery resilient pad may be placed between platform 12 and base 11 and extending at least beneath corners 11*a* and 11*b*.

Figure 1D:
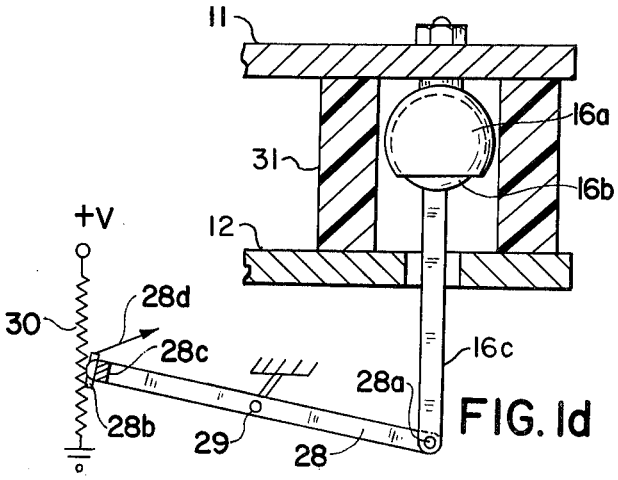
FIG. 1*d* shows still another alternative electromechanical embodiment for said sensors.

In a simplified arrangement shown in FIG. 1*d*, wherein like numerals designate like elements as between FIGS. 1*b*–1*c* and FIG. 1*d*, rod 16*c* is pivotally connected to one end of rod 28 at 28*a*, which rod is mounted to rotate about a centrally located pivot pin 29. The opposite end of rod 28 carries a contact 28*b* which wipingly engages resistance element 30. Contact 28*b* is electrically insulated from rod 28 by insulator 28*c* and couples the voltage level to the input of VCO 26 (FIG. 1*d*).

The output level of the contact 28*b* may be coupled through lead 28*d* to the input of variable gain amplifier 20 whose gain is controlled by the voltage level at its control input 20*a* (FIG. 2).

Figure 3:
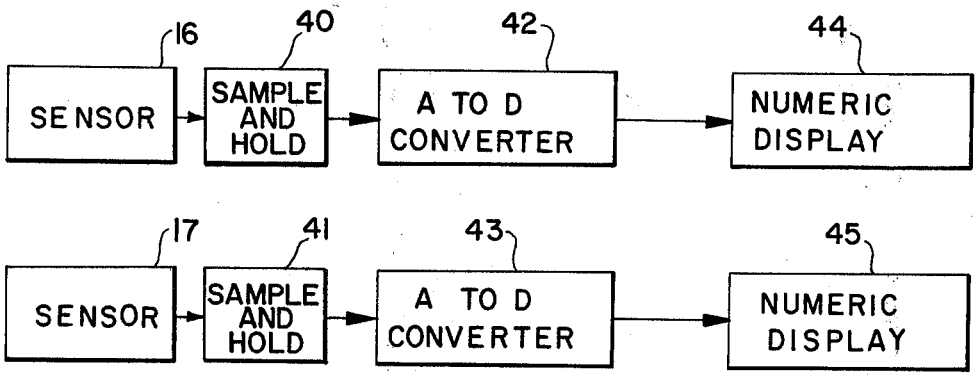
FIG. 3 shows a block diagram of an arrangement for developing another type of readout responsive to platform orientation.

As an alternative to the generation of audio signals the output signals may be employed to generate a color signal whose color and intensity varies as a function of the force applied to the platform (or hand-held squeeze units). Also, the output may be a visual display such as a digital readout as an alternative to or in addition to an audio or visual (color) output. The instrument may be used as an instructional tooth in physics and particularly in vector analysis. As is well known in vector analysis a vector can be represented by two mutually perpendicular vector components by coupling the output of each sensor 16 and 17 to respective analog-to-digital converters 42 and 43 as shown in FIG. 3. The levels may be held by sample-and-hold circuits 40 and 41 associated with the analog-to-digital converters 42 and 43. The digital outputs are utilized to control the displays 44 and 45 which may, for example, be of the segmented display type.

The force applied may thus be represented by its vector components directly readable in decimal digit form. The reverse capability may be obtained by using the individual "squeeze" units 11'-12', 11''-12'' whose outputs may be combined to display a single output display representative of a resultant vector.

Figure 4:
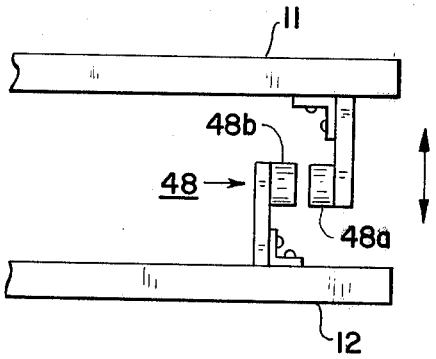
FIG. 4 shows an elevational view of a capacitive type sensor.
Figure 4A:
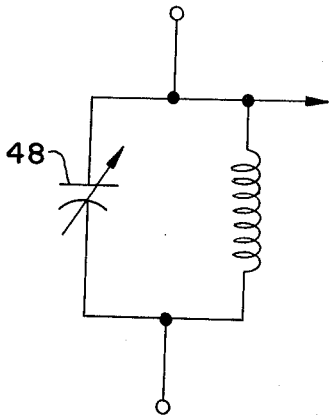
FIGS. 4*a* and 4*b* show two types of circuits which may be employed as sensors for generating the desired output signals.
Figure 4B:
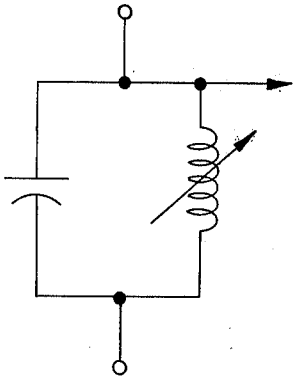

The electromechanical sensors of FIGS. 1*b*–1*d* may be of the form shown in FIGS. 1 and 4 wherein a capacitor comprised of plates 48*a* and 48*b* are mounted to platform 11 and base 12, respectively. The variable capacitor 48 may be employed as one element of a tuned circuit as shown in FIG. 4*a*. The adjustable sensor element may be a variable inductor as shown in FIG. 4*b* wherein the inductance is adjusted responsive to displacement of the corner in which it is mounted. Alternatively, a variable capacitance may be an adjustable element of a monostable multivibrator whose operating frequency is a function of the value of capacitor 16 (FIG. 1)

Figure 5:
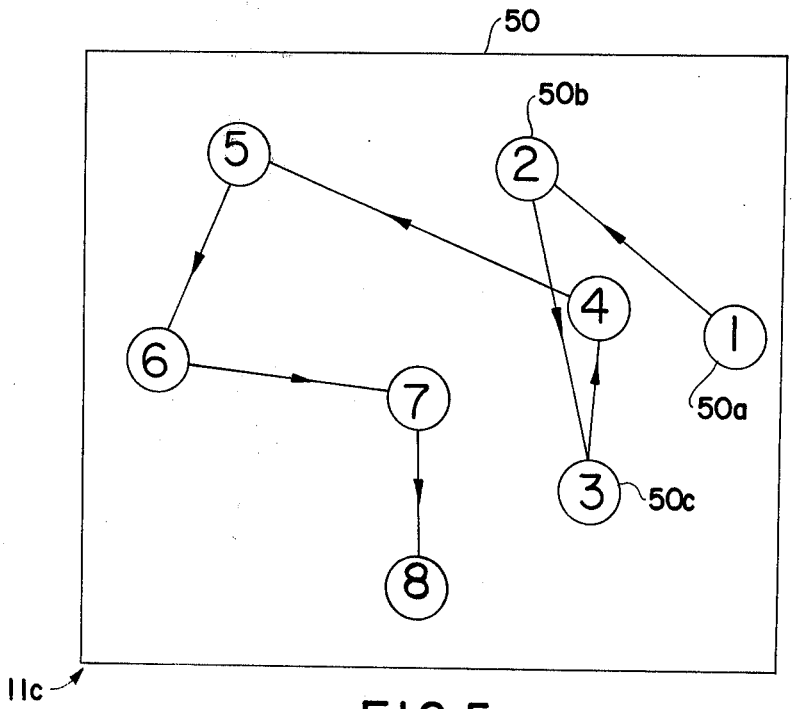
FIG. 5 shows an overlay which may be employed to aid beginners in mastering the platform shown in FIG. 1.
Figure 6:
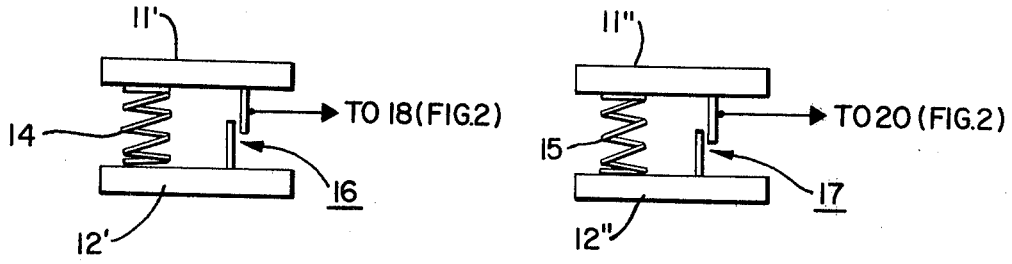
FIG. 6 is a simplified view of an alternative embodiment of the present invention which comprises a pair of hand-held "squeeze" units.

The novice may be taught to play music on the "platform" instrument by the overlay 50 shown in FIG. 5 which is placed upon the top surface of platform 11. By the application of force upon each spot 50*a*, 50*b*, etc. in the sequential order represented by the numbers shown in each spot, it is possible to play a simple tune. Different tunes may be played by changing the overlay. Once the instrument is mastered, the player is free to play his or her own musical selection.

Figure 8:
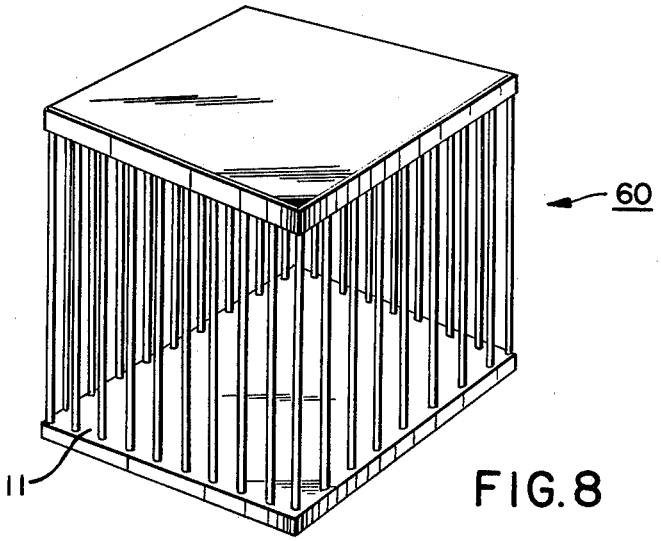
FIG. 8 shows a perspective view of a cage employing the platform apparatus of FIG. 1.

The platform 11, although shown as being rectangular, may be square, diamond or even triangular. The platform 11 may also be curved so as to be circular or elliptical (oval) shaped. The edges of the platform 11 may be scalloped or form other fanciful shapes such as a cardiod (heart) and even diverse shapes to enhance its appeal to different age groups. Size may be adjusted to enable one or more than one person to move about the platform. The platform 11 may even serve as the floor of a cage for small animals, FIG. 8 showing a cage 60, the floor of the cage being formed by platform 11.

Figure 7:
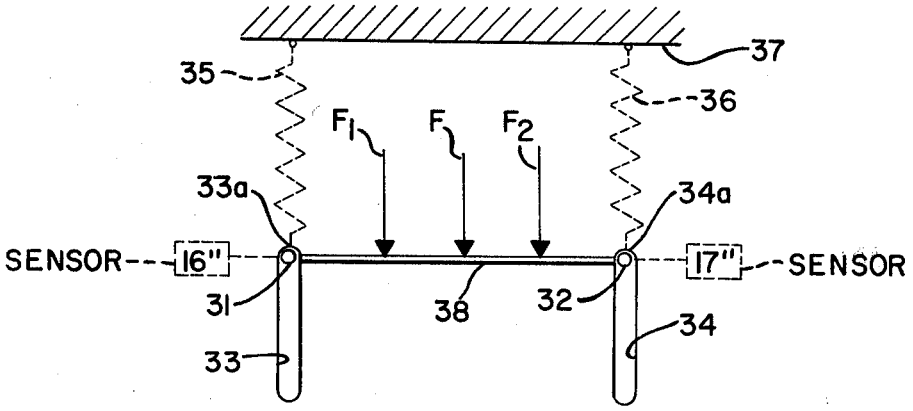
FIG. 7 shows a simplified plan view of still another embodiment of the present invention.

As another alternative embodiment 30 shown in FIG. 7, a pair of pins may be guided along a pair of linear parallel paths, said pins 31, 32 extending through a pair of elongated linear parallel slots 33, 34 respectively, to obtain the desired movement. Each pin 31, 32 may be secured to one end of an associated bias spring 35, 36, each spring having its opposite end secured to a stationary frame 37 so as to bias both pins 31, 32 in the same direction whereby both pins 31, 32 are normally urged against the first ends 33*a*, 34*a* of their slots, for example. An elongated rod 38 is pivotally connected to both pins at spaced intervals along the rod.

A sensor 16'', 17'' is provided for each pin 31, 32 to sense the position of its associated pin and thereby provide a signal representative of the amount of movement each pin experiences in moving away from its normal position, i.e. its "rest" position. By applying a force F to the rod in a direction to move it away from the aforesaid "rest" position the pins may accordingly be likewise moved away from their "rest" positions by an amount determined by the point along the rod at which the force is applied. By applying the force F at a point midway between the pins, each pin will move away from the "rest" position by equal amounts. By applying the force $F_1$ (or $F_2$) to either side of the aforesaid midway point, the pins 31, 32 will move away from their "rest" positions by unequal amounts. By coupling the outputs of the sensors to the inputs of oscillator 18 and amplifier 20, respectively, as shown in FIG. 2, the above scheme may also be utilized to produce music.

A latitude of modification, change and substitution is intended in the foregoing disclosure and, in some instances some teachings of the invention will be employed whithout a corresponding use of other features. Accordingly, it is appropriate that the appended claims be construed broadly in a manner consistent with the spirit and scope of the invention herein.

What is claimed is:

1. Means for controlling the frequency and amplitude of a signal comprising:

a base member;

a platform;

means for mounting said platform upon said base member to permit swingable movement of the platform in mutually orthogonal directions;

first and second sensors respectively arranged at first and second positions spaced from said mounting means for generating outputs representative of the displacement distance between the platform and said base measured at said first and second positions;

variable frequency generator means responsive to the output of one of said sensors for generating an output signal whose operating frequency is a function of the signal level applied to said generator means; and means responsive to the output of the remaining one of said sensors for controlling the amplitude of the output signal generated by said variable frequency generator means.

2. The apparatus of claim 1 wherein resilient means are provided between said platform and said base member for urging said platform away from said base member at least at said first and second positions.

3. The apparatus of claim 1 wherein said generator means generates a signal whose frequency lies within the audio range.

4. The apparatus of claim 1 wherein said mounting means comprises pivot means for pivotally joining said platform to said base.

5. The apparatus of claim 2 wherein each of said sensors comprises means for generating an electrical signal whose magnitude is a function of the displacement of the platform relative to said base member at the position of said sensor.

6. The apparatus of claim 1 further comprising speaker means for converting the output signal of said generator means into an audible signal.

7. The apparatus of claim 1 further comprising a cage for housing an animal;

said platform forming the floor of said cage.

8. The apparatus of claim 1 further comprising an overlay sheet positioned upon said platform and having indicia positioned upon said overlay whereby forces applied at the positions of said overlay indicia cause certain tones to be generated; said indicia being numbered in a predetermined sequence whereby a particular sequence of tones will be generated when said forces are applied at the positions of said indicia in accordance with the order called for by said indicia.

9. Apparatus for controlling the frequency and amplitude of a signal comprising:

a base member;

a platform;

first means for swingably mounting said platform upon said base member;

first and second sensor means being spaced apart from one another and each being positioned a predetermined distance from said first means;

frequency generator means for generating a variable frequency output;

said first sensor means comprising means for altering the operating frequency of said frequency generator means as a function of the displacement distance between the platform and the base member at the location of the first sensor means;

variable gain amplifier means for amplifying the output of said frequency generator means; and said second sensor means comprising means for altering the gain of said variable gain amplifier means as a function of the displacement distance between said platform and base member at the location of said second sensor means.

10. The apparatus of claim 9 further comprising resilient means for maintaining a finite displacement between said base and platform members at least at the locations of said first and second sensor means and being compressible to enable the displacements to be altered by application of a force to said platform.

11. Apparatus for controlling the amplitude and frequency of a signal comprising:

first and second elongated slots;

first and second slidably mounted members respectively arranged to slide along said first and second elongated slots, said slots being linear and being arranged in spaced parallel fashion;

bias means for uging both of said slidably mounted members in a first direction;

a rod being pivotally connected to said slidably mounted members;

first and second sensors each being associated with one of said first and second slidably mounted members for detecting the displacement experienced by its associated slidably mounted member;

a frequency generator responsive to one of said sensors for altering its output frequency according to the displacement experienced by the associated slidably mounted member; and a variable gain amplifier for amplifying the output of said frequency generator, said amplifier having its gain altered as a function of the displacement experienced by its associated slidably mounted member and measured by the associated sensor.

* * * * *

UNITED STATES PATENT AND TRADEMARK OFFICE

CERTIFICATE OF CORRECTION

PATENT NO. : 4,245,539

DATED : January 20, 1981

INVENTOR(S) : Alan P. Jones

It is certified that error appears in the above—identified patent and that said Letters Patent is hereby corrected as shown below:

On the title page, Item (73) after Hammonton, N.J. insert -- a part interest --.

In the abstract, line 7, after "second" insert --opposite--.

In the abstract, line 8, delete "opposite".

Column 1, line 43, before "achieve" insert --simultaneously--.

Column 1, line 44, delete "simultaneously".

Column 2, line 22, change " ; " to -- . --.

Column 5, line 50, change "tooth" to --tool--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*